US005190150A

United States Patent [19]

Laue et al.

[11] Patent Number: 5,190,150

[45] Date of Patent: Mar. 2, 1993

[54] BALL BEARING PLUNGER ACTUATOR FOR A SWITCH

[75] Inventors: Gregory L. Laue; William J. Kipp; James P. Miller, all of Freeport, Ill.

[73] Assignee: Honeywell Inc., Minneapolis, Minn.

[21] Appl. No.: 728,407

[22] Filed: Jul. 11, 1991

[51] Int. Cl.[5] ..... H01H 3/16

[52] U.S. Cl. ..... 200/341; 200/47; 200/520; 200/573; 200/DIG. 29

[58] Field of Search ..... 200/47, 52 A, 61.41, 200/61.71, 520, 573, 329, 338, 341, 345, DIG. 29

[56] References Cited

U.S. PATENT DOCUMENTS

| | | | |
|---|---|---|---|
| 2,487,922 | 11/1949 | DeChant et al. . | |
| 3,300,597 | 1/1967 | Hewett . | |
| 3,829,637 | 8/1974 | Kilcoin | 200/47 |
| 3,931,484 | 1/1976 | Chace et al. | 200/47 |
| 4,136,569 | 1/1979 | Hollweck | 200/521 |
| 4,139,756 | 2/1979 | Tsen et al. | 200/330 |

OTHER PUBLICATIONS

IBM Technical Disclosure Bulletin, vol. 10, No. 11 Apr. 1968.

*Primary Examiner*—Ernest G. Cusick
*Attorney, Agent, or Firm*—William D. Lanyi

[57] ABSTRACT

A ball bearing plunger actuator for a limit switch is provided with an insert between the ball bearing and the actuator. The insert is disposed into an opening in the distal end of the actuator before insertion of the sphere. After swaging the sphere is captivated within the opening of the actuator with the low friction insert disposed at the bottom of the opening between the sphere and the actuator. In a preferred embodiment of the present invention, the low friction insert is made of a fluorocarbon, such as TFE. Several embodiments of the present invention incorporate inserts which are differently shaped to provide certain advantages in particular adaptations. Two of the embodiments utilized either a generally cylindrical insert with a conical concave part of the insert shaped at one end to receive the ball bearing or, alternatively, a generally flat circular disc of fluorocarbon material which conforms to the bottom of the opening and is inserted into the opening prior to insertion of the sphere.

20 Claims, 2 Drawing Sheets

BALL BEARING PLUNGER ACTUATOR FOR A SWITCH

BACKGROUND OF THE INVENTION

1. Field of the Invention

The present invention is generally related to actuators which are used in plunger-type switches and, more particularly, to actuators which incorporate a sphere within a distal end of the actuator with a low friction insert disposed beneath the sphere to increase the life and improve the wear characteristics of the actuator.

2. Description of the Prior Art

Limit switches have been used in many applications for many years. Likewise, limit switches which utilize a plunger actuator are also very well known to those skilled in the art. Although the plunger actuator of this type of switch can have a plain distal end, actuators of this type often are provided with some means of alleviating potential frictional damage at the distal end of the plunger that could possibly caused by relative movement between the end of the plunger and an external actuating device in a direction which is not parallel to the operating movement of the plunger. In other words, since the plunger actuator is usually intended to move into and out of a switch housing along a direction parallel to the central axis of the plunger, movement in directions which are not parallel to that central axis could cause wear damage at the end of the plunger which contacts the external actuating device. For many years, this frictional wear problem has been addressed by providing either a roller mounted to the distal end of the plunger by an axle means or, alternatively, by a ball bearing disposed in an opening formed at the distal end of the plunger. Each of these solutions finds use in various applications of this type of limit switch.

It is not uncommon to apply a switch in a manner which causes wear of its actuator. U.S. Pat. No. 2,487,922, which issued to De Chant et al on Nov. 15, 1949, describes a curb switch which utilizes a spring-like actuator with a ball at its end. The device is mounted to an automobile for the purpose of indicating proximity between the automobile and an object such as a curb. When the ball at the end of the actuator contacts the curb, the actuator is depressed and a switch mechanism is operated. In this particular case, the ball is not rotatable relative to the actuator.

U.S. Pat. No. 3,300,597, which issued to Hewett on Jan. 24, 1967, discloses a limit switch that includes a spring-load push type plunger rod that is provided with an improved contact head which is designed in such a way that it effectively causes operation of the push rod when contacted at any point through 360 degrees. The switch is relatively easy to install because is does not require orientation in any particular direction. The actuator has a pyramid-shaped device attached to its end to allow downward movement of the actuator plunger in response to contact from virtually any angle in a plane perpendicular to the central axis of the plunger.

When subjected to light duty, limit switches which utilize a ball bearing plunger actuator work in a generally satisfactory manner and exhibit relatively long lifetimes. The ball bearing rotates within an opening of the actuator and alleviates the problems that might otherwise be caused by wear of the distal end of the plunger. However, certain applications require that depression of the plunger into the switch housing be counteracted by an internal spring having a relatively high spring constant. For example, while light duty switches of this type normally require a force of approximately 3 to 6 pounds to actuate the switch by pressing the plunger into the housing, certain applications require that a force of 6 to 12 pounds be utilized to actuate the switch. The reasons for this increased force requirement relate to a need to assure that the switch isn't inadvertently actuated by a relatively slight contact against the plunger and, in some cases, there is a requirement that sustained actuation of the plunger does not permit the plunger to be improperly retained in the actuated position following release of the actuating device as a result of freezing of water or other liquids around the depressed plunger. To counteract this freezing problem, an internal spring with a relatively high spring constant is used to urge the actuator out of the switch housing and away from its actuated position with a force of approximately 6 to 12 pounds. It has been determined that a force of this magnitude is usually sufficient to counteract any restrictions caused by icing at the outside regions of the switch.

These heightened requirements for plunger switches with increased actuation force requirements cause several problems. For example, the force against the distal end of the plunger, needed to counteract the stronger internal spring, is more likely to create wear at the distal end than in the case of a switch with a weaker spring. In addition, the device used to actuate the switch can also experience wear from contact with the plunger under these higher force conditions. It should be understood that, even in applications where the actual number of switch actuations is relatively small, operations which require continually maintained depression of the plunder can create severe wear problems because the distal end of the plunger is in constant contact with the actuating member, under the higher force conditions, for long periods of time during which vibration can cause relative movement between the plunger and the actuating member. For example, if the switch is used in an application wherein a door closure depresses the plunger, continued operation with the door closed will possible damage either the door or the actuator if continued vibration occurs under these high force conditions. This is particularly possible in situations where mobile vehicles use this type of switch to indicate that a door is closed. As the vehicle moves over rough terrain, vibrations and bouncing can cause relative motion between the door and the distal end of the plunger even though relative movement between these components comprises relatively short distances. The vibratory nature of this contact under the high force of the spring within the switch housing will significantly degrade the operation of the switch and reduce its lifetime.

In view of the requirements described above, it would therefore be extremely beneficial if a ball bearing plunger actuator is provided which can withstand the higher forces required of the spring within the switch housing while permitting continued rolling contact between the distal end of the plunger and a device used to activate the plunger by moving into contact with it.

SUMMARY OF THE INVENTION

The present invention provides a modified ball bearing plunger which is capable of withstanding the high forces provided by the spring within the switch housing and, therefore, is able to extend the life of the actuator while also reducing potential damage to devices used to actuate the switch.

A switch made in accordance with the preferred embodiment of the present invention comprises a plunger actuator that has an operative end disposed in a housing of the switch and a distal end extending away from the housing. A sphere is disposed in an opening of the distal end which is shaped to receive the sphere in revolving association therein. The present invention also includes an insert which is disposed between the actuator and the sphere, within the opening. The insert is made of a low friction material so that the sphere is able to slide on the material which, in a most preferred embodiment of the present invention, is a fluorocarbon such as TFE, or Tetrafluoroethylene.

As least three forms of the insert are possible within the scope of the present invention. In one alternative embodiment, the insert is made of a generally flat and deformable disc shaped to conform to the shape of the bottom of the opening within the distal end of the actuator. In an another alternative embodiment of the present invention, the insert is generally cylindrical with one end being shaped to conform to the bottom of the opening with the other end being provided with a generally conical depression shaped to receive the ball in sliding association therein. In a third alternative embodiment of the present invention, the insert is shaped generally like that described above as the second alternative embodiment but, in addition to the conical depression in one end of the insert, the insert is provided with walls that extend upward from the conical depression to provided a low friction separation between the sphere and the walls of the actuator opening.

BRIEF DESCRIPTION OF THE DRAWING

The present invention will be more fully and completely understood from a reading of the Description of the Preferred Embodiment in conjunction with the drawing, in which.

DESCRIPTION OF THE PREFERRED EMBODIMENT

Figure 1:
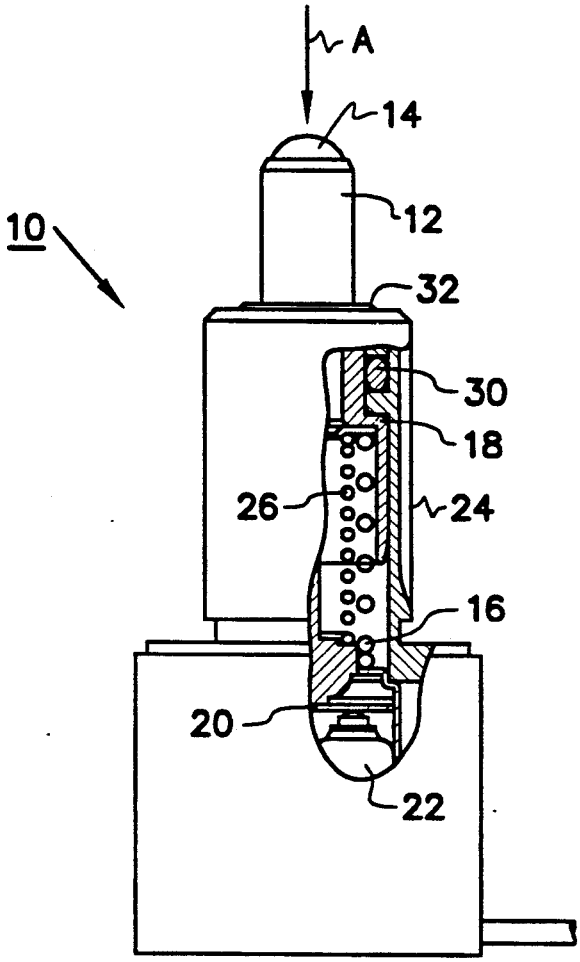
FIG. 1 shows a switch which utilizes a ball bearing plunger actuator which is suitable for use with the present invention.

Throughout the Description of the Preferred Embodiment, like components will be identified by like reference numerals.

FIG. 1 illustrates a switch, generally identified by reference numeral 10, which utilizes a plunger-type actuator 12. In operation, a switch of the type shown in FIG. 1 responds to a downward force, in the direction of arrow A, against a sphere 14 which is rotatably associated within an opening of the actuator 12. This downward force overcomes the force of a spring 16 as the operative portion 18 of the actuator 12 compresses the spring in response to the downward force. According to operations that are well known to those skilled in the art, a portion of the actuator is forced downward against a plate 20 which, in turn, depresses a switching mechanism 22 within the housing of the switch 10. Actuation of the switching mechanism 22 makes or breaks appropriate electrical contact between conductors according the specific application in which the switch 10 is used. Another spring, 26 is used to facilitate the operation of the switch 10 by absorbing excessive motion of the plunger 12 after the plate 20 has moved along its total extent of travel.

With continued reference to FIG. 1, it can be seen that spring 16 determines the downward force required to cause the actuator 12 to move into the housing 24 in response to a contact from an external object in the direction indicated by arrow A. It should be understood that the particular configuration illustrated in FIG. 1 and described above is illustrative of only one possible switching structure that could alternatively be utilized within the housing 24 according to the present invention. The present invention is directed toward facilitating the operation of the actuator 12 when a spring 16 having a relatively high spring constant is used.

In FIG. 1, the actuator 12 is shown being associated with a seal 30 and an ice scraping mechanism 32. These components inhibit foreign matter from migrating downwardly along the actuator 12 and into the inner portion of the housing 24. As described above, certain applications of plunger switches require an actuating force in excess of 6 to 12 pounds of force in the direction of arrow A in FIG. 1. The use of a stronger spring 16 requires that the force in the direction of arrow A be at least sufficient to overcome the spring force in order to actuate the switching mechanism 22. This higher force requirement creates severe wear conditions between the sphere 14 and the internal portions of the opening within the actuator 12.

Figure 2:
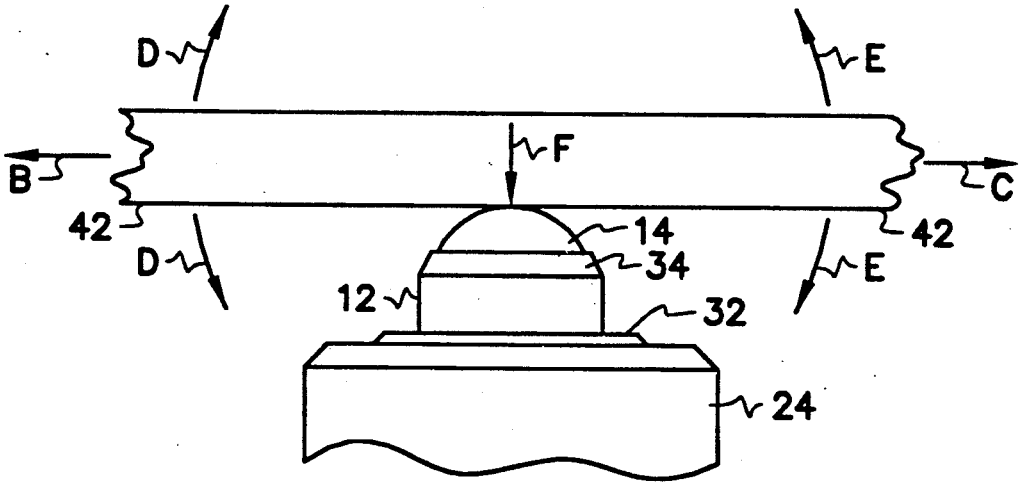
FIG. 2 shows a ball bearing plunger actuator in physical contact with an external actuating device.

FIG. 2 shows an exemplary actuator and a ball, or sphere 14, disposed at the distal end 34 of the actuator 12. It is shown in a depressed, or actuated, position relative to the housing 24. Although the actuator 12 is shown partially extending from the housing 24 in FIG. 2, it should be understood that the illustration in FIG. 2 is intended to show the actuator of the switch in a condition sufficient to actuate the switch and maintain it in an actuated position for an extended period of time. This actuation position is the result of the presence of an external object 40, such as a door, in a position to exert a force such as that represented by arrow F in FIG. 2. The downward force maintains the actuator 12 in a position with most of the actuator 12 pushed into the housing 24. In a switch which has a high force spring 16, the force between the sphere 14 and the external object 40 at their point of mutual contact is approximately 6 to 12 pounds. Therefore, relative movement between the external object 40 and the sphere 14 will cause potential internal wear between the sphere 14 and the internal surfaces of an opening within the distal end 34 of the actuator 12 in a manner which will be described in greater detail below. It should be understood that even though only a single actuation is required to depress the actuator 12 into the housing 24 as shown in FIG. 2, many relative movements between the switch and the external object 40 can occur during that single sustained actuation. For example, if the external object 40 is a device that is mobile, such as an automobile or other similar piece of equipment, vibration can cause continuous relative movement between these components. In FIG. 2, this relative movement is illustrated by arrows B,C,D, and E which are exemplary to illustrate that significant motion can occur at the point of contact even though the actuator 12 is not moved a significant distance into or out of the housing 24. Although the relative movement at the point of force between the sphere 14 and the external object is slight, it can be highly repetitive under vibratory conditions and, in this example, those relative motions occur under a significant force. If the coefficient of friction between the sphere 1 and the internal opening within the actuator 12 exceeds the coefficient of friction between the sphere 14 and the operative surface 42 of the external object 40, the operative surface 42 can experience wear because of the lack of rotation of the sphere 14 within the opening of the actuator. On the other hand, if the conditions are reversed, significant wear can occur at the bottom portion of the opening within the actuator as a result of sliding contact between the sphere and the opening under a heavy force. Under either of these conditions, damage can occur to the switch and/or the external object With reference to FIG. 3, an actuator made in accordance with techniques known to those skilled in the art will be described for purposes of comparison to the present invention. The actuator 12 is provided with an opening 50 in the distal end 34 of the actuator. In typical applications, the bottom portion of the opening 50 is generally conical because of the shape of the drill normally used to provide the opening 50. The conical surface 52 is shaped to receive a sphere 14 in sliding association thereon. As can also be seen in FIG. 3, the depth of the opening 50 is appropriate for receiving a sphere 14 within the opening. Although the sphere 14 is shown by dashed line in FIG. 3, it should be understood that a sphere 14 is disposed in the opening 50 during manufacture of the actuator and, after the sphere 14 is disposed in the opening, the distal end 34 is swaged inwardly to captivate the sphere 14 permanently within the opening 50. One way of captivating the sphere 14 is to provide a force in the directions indicated by arrows G after the sphere 14 is disposed within the opening.

Figure 3:
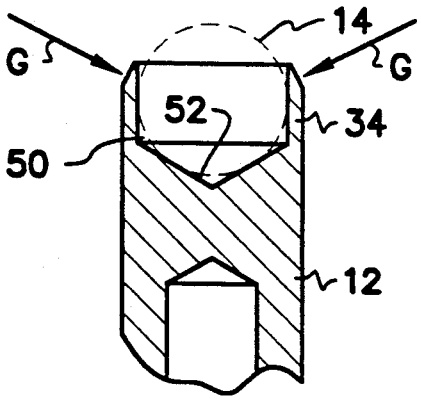
(PRIOR ART) Fig. 3
FIG. 3 shows a ball bearing plunger actuator made in accordance with techniques known in the prior art.

With continued reference to FIG. 3, it can be seen that the contact points between the sphere 14 and the conical surface 52 of the actuator 12 are such that they define a generally circular contact line between these components at which there is a sliding relationship between them. In other words, when the sphere 14 is caused to rotate within the opening 50, a significant amount of rubbing or sliding occurs between the sphere and the bottom of the opening at these locations. In light duty switches, in which the required downward actuating force is generally between 3 and 6 pounds, the forces are usually not sufficient to cause significant damage to the actuator during a normal life time of the switch. However, in high force switches where the internal spring requires a force of approximately 6 to 12 pounds to actuate the switch, the higher force exacerbates the conditions and causes premature wear of both the sphere and the external object used to actuate the switch.

Figure 4:
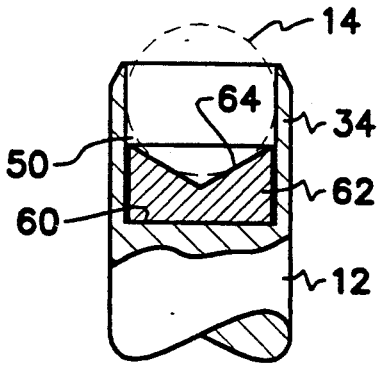
FIG. 4 shows one alternative embodiment of the present invention.

The present invention will be described in terms of three alternative embodiments which all incorporate the basic concept of the present invention. For example, with reference to FIG. 4 it can be seen that the opening 50 within the distal end 34 of the actuator 12 is generally similar to that shown in FIG. 3, but with the opening 50 having a generally flat bottom. Although the specific shape of the bottom of the opening 50 is not part of the present invention, the flat bottom 60 facilitates reception of an insert 62 within the opening 50. Although the insert 62 is shown in sectional view in FIG. 4, it should be understood that it is generally cylindrical in shape with a central axis that is generally coaxially with a central axis of the actuator 12. The bottom portion of the insert 62 is shaped to conform to the bottom surface 60 of the opening 50. If an opening 50 with a conical bottom is used, in a manner such as that described above in conjunction with FIG. 3, the insert 62 can easily be made to have a convex conical bottom which fits the bottom of the opening 50. The upper end of the insert 62 is shaped with conical concave portion which receives the sphere 14 in sliding relation thereon. The insert 62 is made of a low friction material, such a fluorocarbon. The fluorocarbon used to produce the insert 62 could be Tetrafluoroethylene. The lower friction between the sphere 14 and the upper surface 64 of the insert 62 significantly reduces the wear on the outer surface of the sphere 14. In addition, it significantly extends the life of the actuator 12 and, therefore, the switch. During manufacture, the opening 50 is provided in the distal end 34 of the actuator 12. Then, the preshaped insert 62 is disposed into the opening 50. The sphere 14 is then placed onto the upper end of the insert against surface 64. Lastly, at the upper end of the actuator 12, around the lip of the opening, the wall of the opening is swaged to captivate the sphere 14.

Figure 5:
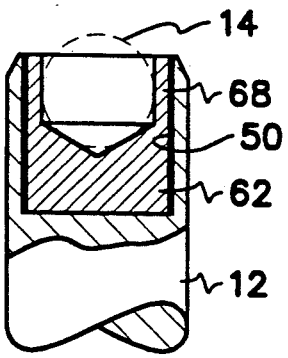
FIG. 5 shows another alternative embodiment of the present invention.

FIG. 5 illustrates an alternative embodiment of the present invention in which the insert 62 is provided with extended walls 68. This forms a cup-like shape into which the sphere 14 is disposed. After insertion of the sphere 14 into the insert 62, the walls of the opening 50 are swaged as described above to captivate the sphere 14. In FIG. 5, it should be noted that the swaging operation in this embodiment of the present invention also deforms the upper portion of the extensions 68. An advantage achieved by using the alternative embodiment shown in FIG. 5 is a further reduction in frictional wear experienced by the sphere 14. In this particular embodiment, the sphere 14 does not slide against any portion of the actuator 12. Instead, it slides only against the low friction material of the insert 62.

Figure 6:
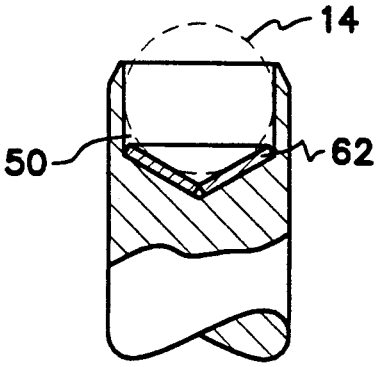
FIG. 6 shows another alternative embodiment of the present invention.

FIG. 6 shows another alternative embodiment of the present invention. The opening 50 is generally identical to the opening shown in FIG. 3. The bottom portion of the opening 50 is conical in shape as a result of the typical shape of a drill bit. In this particular embodiment, the insert 62 is shaped as a flexible disc which is deformable when placed into the opening 50. It is flexible and conforms to the bottom shape of the opening 50. After insertion of the insert 62 shown in FIG. 6, the insert adapts to the shape of the bottom of the opening 50 and achieves a generally conical shape which receives the sphere 14 in sliding relation thereon. As in the other embodiments described above, the upper ends of the wall of the opening are swaged to captivate the sphere 14.

Figure 7:
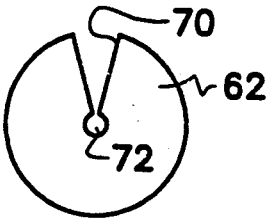
FIG. 7 shows another view of the insert illustrated in FIG. 6.

FIG. 7 illustrates another view of the insert 62 shown in the embodiment of FIG. 6. As can be seen, the insert 62 is generally circular in shape and provides a flexible disc-like component which can be inserted into the opening and which deforms to accommodate the bottom shape of the opening. A portion 70 of the generally circular insert 62 is removed to permit the circular flat sheet to conform to the conically shaped bottom of the opening 50. In addition, a central portion 72 is removed to further facilitate this conformance in shape.

The present invention has been described in terms of three alternative embodiments. However, it should be understood that all three of these embodiments incorporate similar concepts. Namely, the present invention adapts a plunger actuator to reduce the frictional forces experienced by a sphere disposed in an opening at a distal end of the actuator. The adaptation provided by the present invention is an insert which is disposed in the bottom of the opening between the sphere and the bottom of the opening. The insert is made of a low friction material, such as a fluorocarbon, which reduces the coefficient of friction far below that which could be achieved by attempting to make the inner surfaces of the openings smoother. Although it is recognized that a finer finish provided within the inside of the opening could also reduce the coefficient of friction between the sphere and the internal surfaces of the opening, it must be realized that achieving a coefficient of friction as low as that which is provided by a fluorocarbon material is virtually impossible or very difficult to achieve with finer finishes and, even if these extremely smooth finishes were available, the expenses involved would likely preclude their use.

The advantages of the present invention are significant. For example, empirical tests have been run on switches of the type shown in FIG. 1 to determine the advantages of the present invention over the prior art which is shown in FIG. 3. Other than the differences provided by the present invention, the switches were generally similar. Standard switches were actuated in a test facility at a rate of 25 operations per minute. During these tests a 20 degree cam linear actuator was used to simulate extreme operating conditions. The plungers were depressed approximately 0.25 inches and the plunger action was visually monitored for side thrusts and roller bearing rotation. It wa noted that a loud grating noise emanated from the switches after approximately 4,000 operations. The noise was obviously a result of wear damage which occurred because of wear between the sphere and the components against which it slides. After approximately 9,000 operations, the ball bearing in the switches began to loosen within the opening in the actuator. By approximately 10,000 operations, severe damage was seen in the switches. In comparison, switches made in accordance with the present invention were also tested according to procedures which were generally similar to those described above. The ball bearing plungers successfully completed over 100,000 operations with the plunger bearings showing only very slight wear when removed from the test facility after 120,000 operations. The embodiments of the present invention illustrated in FIGS. 4 and 6 were both run under these same conditions and exhibited similar results. The forces against the ball bearings were in the range of 6 to 12 pounds for all of the tests. Another sample of switches made in accordance with the prior art were tested according to the procedures described above, but with a significant amount of grease disposed in the bottom of the opening before insertion of the sphere and captivation of the sphere by the swaging operating. This methodology disposed grease under the sphere within the opening of the actuator. When these types of actuators were tested, it was empirically determined that, in less than 50,000 actuations, excessive damage occurred to the ball bearings and plunger bearing areas with some of the ball bearings actually falling out of the plungers as a result of severe damage resulting during the test. From these comparative tests, it has been determined that a significant improvement in wear resistance and switch life has been achieved by the insertion of the low friction material into the opening prior to the captivation of the sphere.

Although the present invention has been described with particular specificity and illustrated to show several embodiments of the present invention, it should be clearly understood that many other alternative embodiments of the present invention should be considered within its scope.

The embodiments of the invention in which an exclusive property or right is claimed are defined as follows:

1. A switch, comprising:

a housing;

an actuator, said actuator having an operative end disposed in said housing of said switch and a distal end extending from said housing;

a sphere, said distal end having an opening shaped to receive said sphere in revolving association therein; and an insert disposed in said opening between said actuator and said sphere.

2. The switch of claim 1, wherein:

said insert is made of a low friction material, said sphere being disposed in sliding association with said insert.

3. The switch of claim 2, wherein:

said low friction material is a fluorocarbon.

4. The switch of claim 2, wherein:

said insert is a generally flat deformable disc shaped to conform to the shape of the bottom of said opening, said sphere depressing said insert against said bottom of said opening.

5. The switch of claim 2, wherein:

said insert is generally cylindrical having an end that is generally shaped to conform to the shape of the bottom of said opening and another end having an opening shaped to receive said sphere in sliding relation therein.

6. The switch of claim 1, wherein:

a wall of said opening is partially deformed to captivate said sphere within said opening.

7. The switch of claim 1, wherein:

said insert is disposed between the bottom of said opening and said sphere and between said sphere and at least a portion of a wall of said opening.

8. The switch of claim 1, wherein:

said actuator is generally cylindrical and is movable into and out of said housing in a direction parallel to a central axis of said generally cylindrical actuator.

9. The switch of claim 1, further comprising:

a plurality of conductors disposed within said housing; and means disposed within said housing for selectively making or breaking electrical contact between conductors in response to movement of said actuator relative to said housing.

10. A switch, comprising:

a housing member;

an actuator movably associated with said housing member, said actuator having a distal end with an opening therein;

a sphere contained within said distal end of said actuator, a portion of said sphere extending beyond said distal end; and an insert disposed between said sphere and said actuator.

11. The switch of claim 10, wherein:

said insert is made of a low friction material.

12. The switch of claim 11, wherein:

said sphere is disposed in said opening in said distal end of said, said opening being shaped to receive said sphere in rotational association therein.

13. The switch of claim 12, wherein:

said insert is disposed in said opening between said sphere and a bottom of said opening.

14. The switch of claim 13, wherein:

said low friction material is a fluorocarbon.

15. The switch of claim 14, wherein:

said insert is a generally flat disc shaped to conform to said bottom of said opening.

16. The switch of claim 14, wherein:

said insert is generally cylindrical with an end being shaped to conform to said bottom of said opening and an other end shaped to receive said sphere in sliding association therein.

17. The switch of claim 16, wherein:

said other end has a generally conical depression therein.

18. The switch of claim 10, further comprising:

two conductors disposed within said housing member; and means, disposed within said housing member, for selectively making and breaking electrical communication between said two conductors in response to movement of said actuator.

19. The switch of claim 14, wherein:

said actuator is generally cylindrical and movable along a central axis of said actuator into and out of said housing member.

20. A switch, comprising:

a housing having two conductors therein;

an actuator attached in movable association with said housing, said actuator having a distal end and an opening in said distal end of said actuator, said actuator being generally cylindrical;

a sphere disposed in rotatable association within said opening;

an insert disposed within said opening between said sphere and a bottom of said opening, said insert being made of a fluorocarbon; and means, disposed within said housing, for making and breaking electrical contact between said two conductors, said making and breaking means being responsive to movement of said actuator relative to said housing, said movement of said actuator being responsive to contact between said sphere and an external object.

* * * * *